US005823393A

United States Patent [19]

Hafstrom

[11] Patent Number: 5,823,393

[45] Date of Patent: Oct. 20, 1998

[54] DISPOSABLE PACKAGE AND DISPENSER

[75] Inventor: Torvid Hafstrom, Stockholm, Sweden

[73] Assignee: The Scandinavian Candy Co., Inc., Sun Valley, Calif.

[21] Appl. No.: 920,925

[22] Filed: Aug. 29, 1997

[51] Int. Cl.[6] ..... B67D 5/60

[52] U.S. Cl. ..... 222/130; 222/154; 206/769; 220/529

[58] Field of Search ..... 222/130, 154, 222/129, 185.1; 220/529; 206/769

[56] References Cited

U.S. PATENT DOCUMENTS

| | | | |
|---|---|---|---|
| 2,269,761 | 1/1942 | Gauvreau | 222/54 |
| 2,921,720 | 1/1960 | Malachick | 222/154 |
| 4,192,439 | 3/1980 | Segal | 222/154 |

*Primary Examiner*—Philippe Derakshani
*Attorney, Agent, or Firm*—Lyon & Lyon LLP

[57] ABSTRACT

The present invention relates to a consumable product dispenser that is easy to fill with product and also serves as a package for shipment of the product to an intended vending site, is easy to transport, allows vending of most or all of the contained product, remains clean and intact during its intended period of use, and shows potential consumers the contained product in an aesthetically pleasing fashion. A disposable candy dispenser, made of inexpensive and light-weight materials is disclosed, the dispenser including an internal storage region, a front dispensing area, and a front window that contains candy in a position where it can be viewed by potential consumers. A visible product window is also disclosed which displays the contained product and which includes a means for opening the window such that the contents of the window may be moved to another like dispenser, and then dispensed. A removable divider is also disclosed which temporarily separates a storage region from a front open region into which the contents of the window of a like dispenser may be emptied, and which may then be removed subsequent to such filling of the receiving region. The dispenser may be shipped to a vending site with the storage region and window filled with candy, with the removable divider in place, and the receiving region unfilled.

18 Claims, 3 Drawing Sheets

DISPOSABLE PACKAGE AND DISPENSER

The present invention relates to the art of dispensers for consumer products, and more particularly, to disposable dispensers that both contain and display products, such as candy, for sale to consumers.

BACKGROUND

Candy dispensers are presently in use which allow consumers, such as patrons of movie theaters, gas stations, supermarkets, etcetera, to dole a desired amount of candy out of the dispenser, and subsequently, take the candy to a cashier where the candy is weighed and purchased. A scoop is ordinarily provided with which the consumer may retrieve the candy and place it into a bag, box, or the like. The candy is then purchased in and eaten from the bag, box, or the like.

A number of such dispensers are typically arrayed together, so that a like number of different candies may be offered for sale. The dispensers may include a window in which the candy held in the particular dispenser is displayed, so that the consumer can more effectively view the particular candy before deciding whether or not to retrieve some of it for purchase. Somewhat similar dispensers are also used to dispense other consumable products, such as nuts, health foods, buttons, dog treats, soaps, nails, and many other items.

The dispensers of the prior art, however, have suffered certain drawbacks. For example, in the case of dispensers containing candy, broken bits or particles of candy unavoidably separate from the candy whereupon they may then accumulate at the bottom, sides, lid, and window of the dispenser. Consequently, vendors are required to allocate time and resources to cleaning the dispensers. Further, when the dispensers become exhausted, they must be refilled, typically from bags of candy obtained by the vendor. Also, product that is contained in the aforementioned windows may be difficult or impossible to retrieve for purchase. Further still, conventional dispensers, often made out of a clear plastic like plexiglass, suffer from the tendency to break, burst, or split during refilling, and tend to be relatively expensive to repair.

Accordingly, there is a great need for a disposable dispenser that fulfils one or more of the following objectives: is easy to fill with product at the factory and doubles as a package for shipment of the product to an intended vending site, is easy to transport, allows vending of most or all of the contained product, remains clean and intact during its intended period of use, and shows potential consumers the contained product in an aesthetically pleasing fashion.

SUMMARY OF THE INVENTION

The dispenser according to the present invention may be made of inexpensive materials such as cardboard and light transparent plastic or other appropriate inexpensive materials, such that the entire dispenser can also serve as a container for shipping the packed product in the dispenser to the vendor. Thus, the dispenser can be shipped with product, e.g., candy, included, the dispenser disposed of when the contained product is exhausted, and a new dispenser with new product then substituted in its place for further sales. As a result, labor and maintenance costs can be reduced, and there is no need for the vendor to be serviced by the supplying company, other than through the delivery of new loaded dispensers.

The dispenser of the present invention may include a window having an internal space within which product resides in a position where it can be viewed by potential consumers. This window may include perforations, allowing a vendor to easily break open the window and spill its contents out and into another dispenser for subsequent sale. The dispenser may also include a removable divider that, when in place, creates an empty receiving region in the dispenser which is separated from the primary storage region of the dispenser wherein the bulk of the dispenser's product resides. The receiving region can receive the product emptied out of the window of a previous dispenser, and the divider can then be removed so that all of the contained product may be retrieved.

Accordingly, it is an object of the present invention to provide a disposable dispenser that meets one or more of the following goals: is easy to fill with product at the factory and doubles as a package for shipment of the product to an intended vending site, is easy to transport, allows vending of most or all of the contained product, remains clean and intact during its intended period of use, and shows potential consumers the contained product in an aesthetically pleasing fashion. It is another object to provide a dispenser that is well-suited for shipping, display, and dispensing of products that are relatively small and numerous, such as candy, nuts, health foods, buttons, dog treats, soaps, nails, and many other items. Other objects and advantages of the invention will become apparent to those skilled in the art upon review of the following drawings and description of the preferred embodiment and the appended claims.

DETAILED DESCRIPTION OF A PREFERRED EMBODIMENT

FIGS. 1–5 show an embodiment of a disposable dispenser according to the present invention. It should be noted that while a preferred embodiment of the invention is described in the context of dispensing candy, products other than candy that are also relatively small and numerous, such as nuts, health foods, buttons, dog treats, soaps, nails, and many other items, may be shipped, displayed, and dispensed from a disposable dispenser according to the present invention. Accordingly, references herein to "candy" may be appropriately substituted with any other particular consumer product that is amenable to being shipped, displayed, and dispensed in the dispenser described herein.

Figure 1:
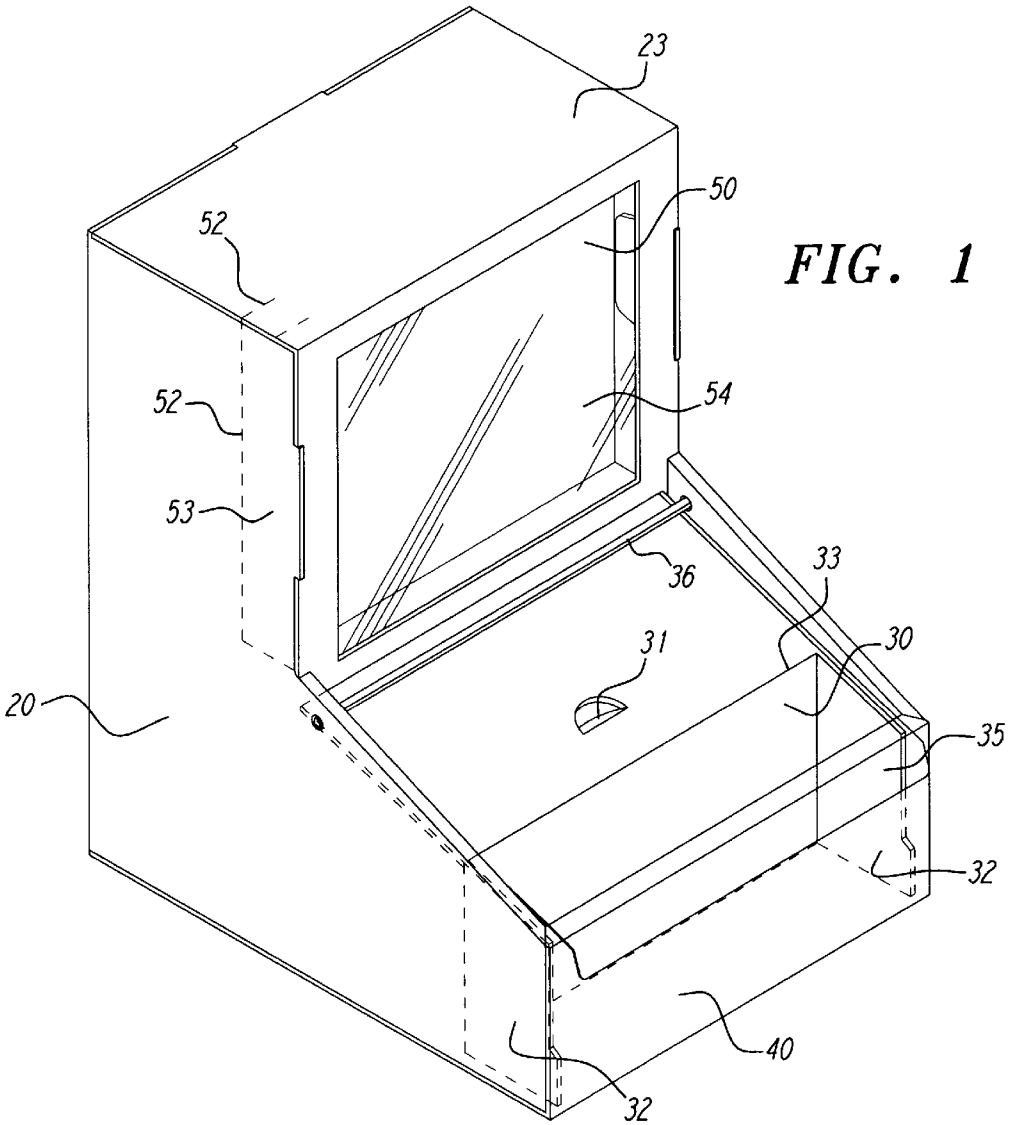
FIG. 1 is a perspective view of a dispenser according to the present invention, showing the removable divider in place and the dispensing lid down.

FIG. 1 shows a perspective view of the dispenser with the divider 30 in place as it is shipped to a vendor (the contained candy, however, is not shown in FIG. 1). The divider 30 includes extensions 32 the forward edges of which abut the front fixed wall of the dispenser and keep the divider 30 from moving or failing forward into receiving region 40. The extensions 32 have tabs 37 at the lower region of their forward edges, which insert into opposing slots (not shown) in the front face of the dispenser. The opposing slots are sufficiently deep to allow the tabs 37 to insert fully, such that the remaining portion of the forward edge of each extension 32 can lay fully abutted against the front face of the dispenser.

On the other side of the divider 30 is the primary storage region 20 in which candy is stored. The dispenser can be shipped to a vendor with this storage region 20 (and the window internal space 50, as discussed below) filled with candy, so that the dispenser doubles as a package for shipping candy to the vendor. The receiving region 40, which is separated from the storage region 20, is shipped empty. When the storage region 20 is filled, the pressure from the contained contents urges the extensions 32 forward, preventing the tabs 37 from escaping from the respective opposing slots (assuming the tabs 37 were properly lined up with for insertion into the opposing slots just prior to filling the storage region 20 with product). This, in turn, prevents the divider 30 from moving out of place (also, as can be seen more clearly in FIG. 3, the rear upper face of the divider 30 extends rearwardly beyond the rear-most extent of the dispensing area 34, and is thus physically obstructed by the inside of the dispenser from pivoting far enough upwardly to allow spillage of contents). The divider 30 also includes a fold line 33 running transversely across it, allowing it to fold substantially in half so that it can be easily removed from the dispenser. The divider 30 also includes a finger hole 31 that allows the divider to be easily grasped for removal. To remove the divider 30, the vendor simply inserts a finger in the finger hole 31, and presses rearwardly on the vertically-oriented face with an opposing finger. This forces the tabs 37 to slide out of their respective opposing slots, whereupon the divider 30 can be pulled outwardly at the finger hole 31, folded as necessary at fold line 33, and then removed entirely from the dispenser.

The dispenser of this embodiment also includes a visible window which contains candy for viewing. Thus, the consumer is allowed to more clearly see the particular candy he is contemplating purchasing beforehand. The visible window includes a translucent window pane 54 and a closed internal window space 50 wherein candy is enclosed and stored for viewing. The volume of the internal window space 50 may be approximately the same as that of the receiving region 40, such that when the primary storage region 20 of the dispenser is exhausted of candy, the candy still enclosed in the space 50 may be accessed and transferred to the receiving region 40 of another like dispenser that has just been received by the vendor, stocked with candy.

The candy enclosed in the space 50 may be accessed by opening the side panel 53 of the window which has perforations 52 running its length. The candy can then be spilled out of the internal window space 50 and into receiving region 40 of a new dispenser that has its primary storage region 20 already stocked. The old dispenser, now completely empty, is discarded. The divider 30 of the new dispenser is removed and discarded, and the original candy contents of space 50 of the old dispenser join the candy contents of the primary storage region 20 of the new dispenser. The contents of the new dispenser can then be dispensed.

Figure 2:
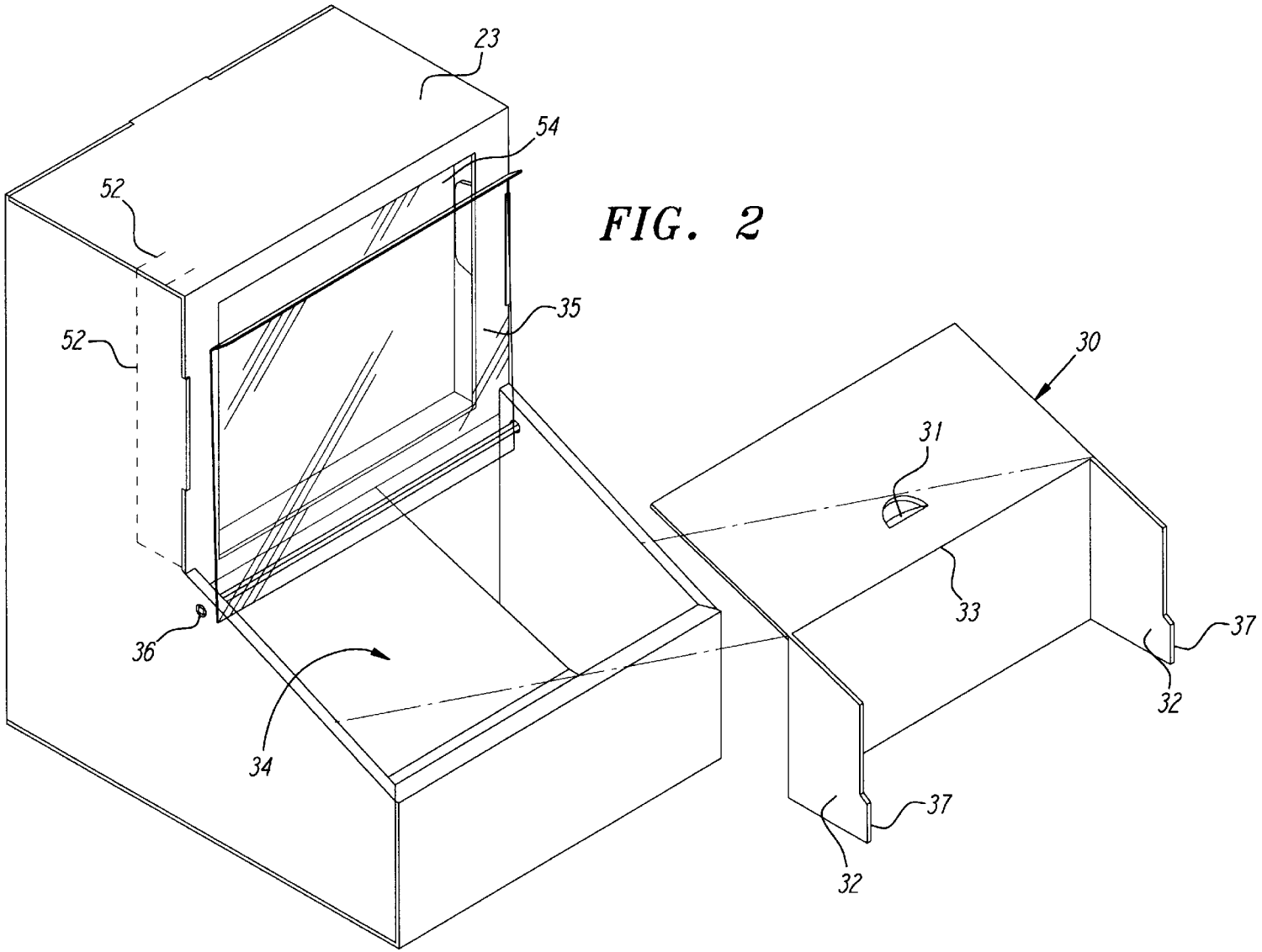
FIG. 2 is a perspective view of a dispenser, showing the removable divider removed and the dispensing lid up.

As can be seen in FIG. 2, the candy can be dispensed at the dispensing area 34, by opening the clear plastic dispenser lid 35 which pivots about a hinge 36. A scoop, not shown, may be provided for scooping candy out at area 34. The dispenser may also include a top lid 23 which may be opened to stock candy in the primary storage area 20 prior to shipping the dispenser to a candy vendor.

Figure 3:
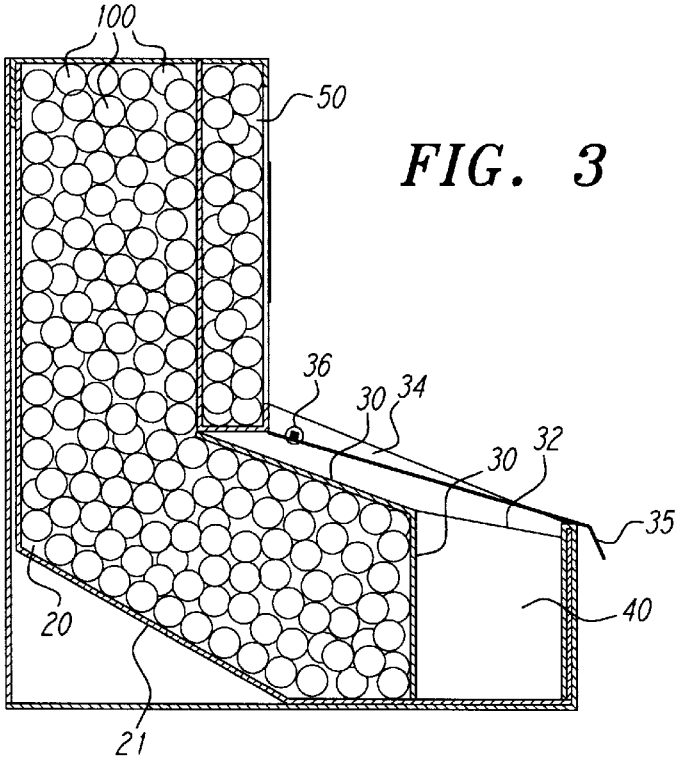
FIG. 3 is a cutaway side view of a dispenser, showing the primary storage area and window each filled with consumable products such as candy, with the divider in place.
Figure 5:
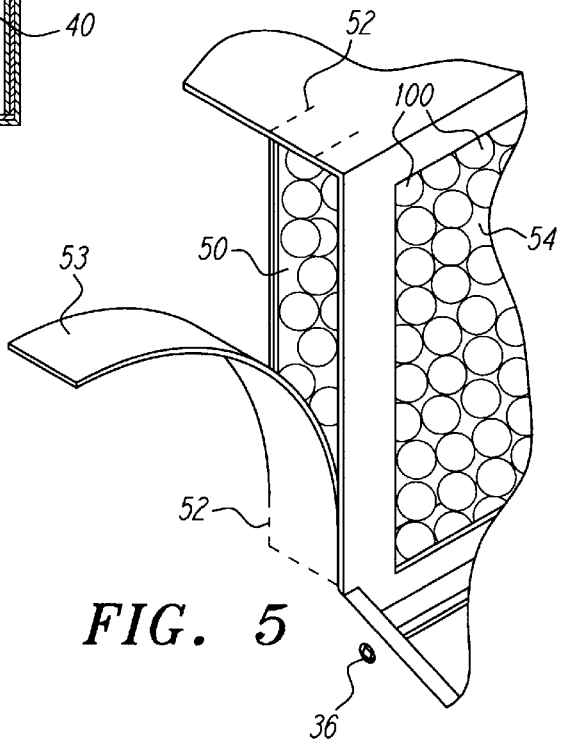
FIG. 5 is a partial perspective view of a dispenser, showing a perforated side wall of the window being ripped open to allow the contents of the window to be removed.
Figure 4:
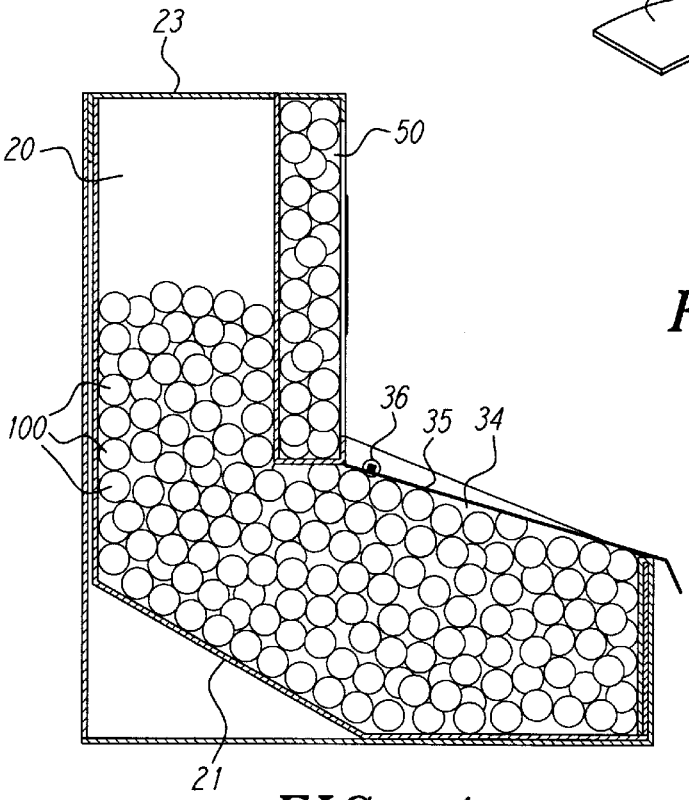
FIG. 4 is a cutaway side view of a dispenser, showing the divider removed.

FIGS. 3–5 further illustrate how the present embodiment of the invention works. FIGS. 3 and 4 also show an inclined bottom wall 21 of the dispenser, which serves to urge forward the candy contents 100 contained in the primary storage area 20, such that the candy 100 moves generally towards the dispensing area 34 due to the force of gravity. FIG. 3 shows the dispenser as it is shipped to a vendor, with candy 100 filling the primary storage region 20 and the internal window space 50, and with the divider 30 in place and separating the filled storage region 20 from the empty region 40. In FIG. 4, the dispenser is shown after the divider 30 has been removed. FIG. 4 represents what the dispenser would look like if the dispenser were received and there were no window contents of a previous dispenser to place in the receiving region 40 prior to removing the divider 30. This would happen, for example, when the vendor obtains the very first dispenser of a given candy. If there were a previous dispenser, however, from which the window contents could be emptied into the receiving region 40, then the dispenser of FIG. 4 would appear differently in that candy 100 would extend all the way to the top lid 23.

Finally, FIG. 5 shows a close-up view of the side panel 53 of the visible window, showing how the panel 53 is ripped open at its perforations 52 to allow candy 100 to spill out from the internal window space 50. The perforations 52 at the top are not shown as being ripped open, but they also may be ripped open further open the window and/or to facilitate grasping and opening the panel 53.

It should be noted that a dispenser of the configuration shown in FIGS. 1–5 may be shipped with pairs of the dispensers "mated" together with their fronts facing each other and each oriented upside-down with respect to the other, so as to save space for easier and less expensive shipping.

Although the present invention has been described in detail with reference to a preferred embodiment thereof, dimensional and configurational variations and other modifications will be readily apparent to those skilled in the art. Therefore, the spirit and scope of the appended claims should not be understood as limited to the particulars of the foregoing description.

What is claimed is:

1. A disposable dispenser comprising:

an internal space defined by a plurality of fixed walls and an open dispensing area, said open dispensing area located towards the front of the dispenser;

a removable divider positioned and temporarily locked within said internal space so as to define and separate from each other a closed primary storage region and a receiving region, said primary storage region being filled with a product to be dispensed and closed off from said open dispensing area by said divider, and said receiving region being devoid of said product; and a visible product window including:

a closed internal window space filled with said product;

a translucent window pane located in a visible position of said dispenser and defining a side of said internal window space; and a means for opening said internal window space so as to allow the removal of the product contained therein.

2. The dispenser of claim 1, wherein the dispenser comprises inexpensive materials such that the dispenser can be economically disposed of after its contained product is exhausted.

3. The dispenser of claim 1, wherein said internal space includes a means for urging the product contained therein in the direction of said open dispensing area.

4. The dispenser of claim 3, wherein said means for urging comprises a bottom fixed wall that is more elevated in the rear of said dispenser than in the front of said dispenser, such that contained product tends to move forward to the dispensing area due to the force imposed by gravity.

5. The dispenser of claim 1 wherein the volume of said sealed internal window space is approximately equal to the volume of said receiving region.

6. The dispenser of claim 1 wherein one of said fixed walls defining said internal space is a lid at the top of said dispenser, said lid being capable of being opened to allow filling of the dispenser at a factory or the like.

7. The dispenser of claim 1, further comprising a scoop that fits easily into said dispensing area.

8. The dispenser of claim 1 wherein said removable divider includes a means for facilitating extraction of said divider from the dispenser.

9. The dispenser of claim 8, wherein said means for facilitating extraction includes a finger hole in said divider, said finger hole located in or near the open dispensing area.

10. The dispenser of claim 8, wherein said means for facilitating extraction includes at least one fold line running transversely across said divider.

11. The dispenser of claim 1, wherein said means for opening said window comprises perforations running the length of one side of said internal window space.

12. The dispenser of claim 11, further comprising a finger tab adjacent to said perforations.

13. The dispenser of claim 1, said divider further comprising extensions that extend forwardly to abut against a fixed wall of the dispenser, holding said divider in place.

14. The dispenser of claim 13, said dispenser including a front face having slots, and said extensions each further comprising a forward edge including a forwardly-projecting tab inserted in one of said slots.

15. The dispenser of claim 14, said divider further comprising a rear face that extends beyond the rear-most extent of said open dispensing area, such that said rear face cannot pass through said open dispensing area unless said tabs are removed from said slots.

16. The dispenser of claim 1, further comprising a clear plastic pivoting dispensing lid covering said open dispensing area.

17. The dispenser of claim 1, wherein the product is candy.

18. A disposable candy dispenser made of inexpensive materials and comprising:

an internal space defined by a plurality of fixed walls and an open dispensing area covered by a clear plastic pivoting dispensing lid, said open dispensing area located towards the front of the dispenser;

said plurality of fixed walls including a front wall having slots;

a removable divider positioned within said internal space so as to define and separate from each other a closed primary candy storage region and a receiving region, said primary storage region being filled with candy and closed off from said open dispensing area by said divider, and said receiving region being devoid of candy;

said removable divider including extensions that extend forwardly and have forward edges abutting against a front wall of the dispenser;

said extensions each including a tab inserted into said slots of said front wall; and a visible candy window including:

a closed internal window space having a volume equal to that of said receiving region, said internal window space being filled with candy;

a translucent window pane located in a visible position of said dispenser and defining a side of said internal window space;

perforations running the length of one side of said internal window space; and a finger tab adjacent to said perforation.

* * * * *